US008430267B2

(12) United States Patent
Kilduff et al.

(10) Patent No.: US 8,430,267 B2
(45) Date of Patent: Apr. 30, 2013

(54) WASTE CONTAINER WITH SNAP-IN GRAB BAR

(75) Inventors: James R. Kilduff, Sidney, MI (US); Linda R. Umlor, Grandville, MI (US); Brian G. Parker, Alto, MI (US); Jeffrey W. Miles, Lowell, MI (US); Joseph A. Bollo, Jr., Hudsonville, MI (US); Dean T. Miller, Wyoming, MI (US); Michael A. Barrett, Lyons, MI (US)

(73) Assignee: Cascade Engineering, Inc., Grand Rapids, MI (US)

( * ) Notice: Subject to any disclaimer, the term of this patent is extended or adjusted under 35 U.S.C. 154(b) by 6 days.

(21) Appl. No.: 13/221,324

(22) Filed: Aug. 30, 2011

(65) Prior Publication Data

US 2013/0048654 A1 Feb. 28, 2013

(51) Int. Cl.
*B65D 35/32* (2006.01)

(52) U.S. Cl.
USPC ..... 220/770; 220/751; 220/759; 220/762; 220/908

(58) Field of Classification Search ..... 220/694, 220/908, 757, 751, 759, 762, 770, 756, 764, 220/761, 763; 206/298, 443, 446
See application file for complete search history.

(56) References Cited

U.S. PATENT DOCUMENTS

| | | | | |
|---|---|---|---|---|
| 3,164,402 | A | 1/1965 | Garland | |
| 4,257,525 | A * | 3/1981 | Thompson | 215/396 |
| 5,103,969 | A * | 4/1992 | Tarozzi | 220/763 |
| 5,538,158 | A * | 7/1996 | Prout et al. | 220/771 |
| 5,582,322 | A * | 12/1996 | Prout et al. | 220/771 |
| 5,904,269 | A * | 5/1999 | Wolff | 220/756 |
| 7,172,088 | B2 | 2/2007 | McDade et al. | |
| 7,350,999 | B2 * | 4/2008 | Brletich et al. | 403/10 |
| 8,061,492 | B2 * | 11/2011 | Riedel et al. | 220/756 |
| 8,096,565 | B2 * | 1/2012 | Meers | 220/908 |
| 8,141,455 | B2 * | 3/2012 | Ogburn | 74/551.8 |
| 8,146,774 | B2 * | 4/2012 | Parker et al. | 220/757 |
| 2004/0108320 | A1 | 6/2004 | Brletich et al. | |
| 2009/0293667 | A1 | 12/2009 | Ogburn | |
| 2010/0230427 | A1 | 9/2010 | Parker et al. | |

* cited by examiner

*Primary Examiner* — Andrew Perreault
(74) *Attorney, Agent, or Firm* — Warner Norcross & Judd LLP

(57) ABSTRACT

A waste cart includes a container having first and second wall portions, and first and second openings defined by the wall portions to receive and support a grab bar. The container includes at least one positioning element to constrain the lateral movement of the grab bar. During assembly, the first end of the grab bar is inserted through the opening in the first sidewall, and the grab bar is pivoted to align the grab bar with the opening in the second sidewall. During the pivoting of the grab bar, the first positioning element is deformed. The second end of the grab bar is inserted into the opening in the second sidewall, allowing the first positioning element to snap back to its original, non-deformed orientation. When the grab bar is installed, the positioning elements are positioned at the outer ends of the grab bar.

8 Claims, 6 Drawing Sheets

WASTE CONTAINER WITH SNAP-IN GRAB BAR

BACKGROUND OF THE INVENTION

The present invention relates to waste containers, and more particularly to waste containers including grab bars.

Wheeled waste carts and other waste containers are well known and are commonly used in residential areas. The bags of waste that a resident accumulates throughout a given week are typically stored in a waste cart. On a scheduled day, the resident wheels the cart to the curb for pickup by a waste truck so that the contents of the waste cart can be dumped into the truck. The dumping may occur manually or using machinery on the truck that is adapted to automatically lift the waste cart, turn the cart over and dump its contents into the truck. On some trucks, the machinery includes arms that grasp the sides of the cart. On other trucks, the machinery includes a lifting plate with a catch mechanism on the upper face of the plate that interfits with a lift pocket, bar, or other lifting structure on the cart. Typically, below the lifting structure on a waste cart is a bar, generally called a grab bar. The grab bar is latched onto by hooks extending out of the face of the lifting plate. The hooks latch onto the grab bar to keep the waste cart from following the waste into the truck when tipped into the truck.

The grab bar is typically made of metal, fiberglass or plastic. The bar extends through openings in two wall portions of the cart. To prevent the ends of the bar from sliding back through either of the openings, the bar is typically long enough so that the ends of the bar reach or nearly reach the inner surfaces of the sides of the cart.

Alternatively, and especially with shorter bars, retainer pins and/or clips can be used to secure the grab bars within the cart. The pins and clips can be secured to the bar after the ends of the bar have been inserted through the openings in the cart. Because the clips and pins prevent the ends of the bar from sliding back through the openings, the bar can be shorter.

SUMMARY OF THE INVENTION

The present invention includes a waste container with integrally molded positioning/retaining elements for securing a grab bar in position. At least one of the elements flexes to enable the grab bar to be assembled into the cart, and the elements retain the grab bar in position following assembly. The invention also includes the method of assembling the cart and securing the grab bar.

In the current embodiment, the container has first and second wall portions defining respective first and second openings separated by a first distance. A grab bar is positioned within the first and second openings. The grab bar has a length greater than the first distance. The container has a first positioning element positioned outside of the space between the first and second walls. The first positioning element extends toward the first end of the grab bar and is adapted to constrain a movement of the grab bar.

The container also has a second positioning element and at least one of the positioning elements is deformable. One or both positioning elements may be offset from a longitudinal axis of the grab bar.

During installation of the grab bar, one end of the grab bar is inserted into the first opening and pivoted, which flexes or otherwise deforms the first positioning element. Then the other end of the grab bar is aligned with and inserted into the second opening, which allows the first positioning element to return to its original, non-flexed or non-deformed orientation. The grab bar is thus retained between the first and second positioning elements. Thus, the grab bar can be assembled into the container quickly and securely.

These and other advantages and features of the invention will be more fully understood and appreciated by reference to the description of the current embodiment and the drawings.

DESCRIPTION OF THE CURRENT EMBODIMENT

I. Construction

Figure 1:
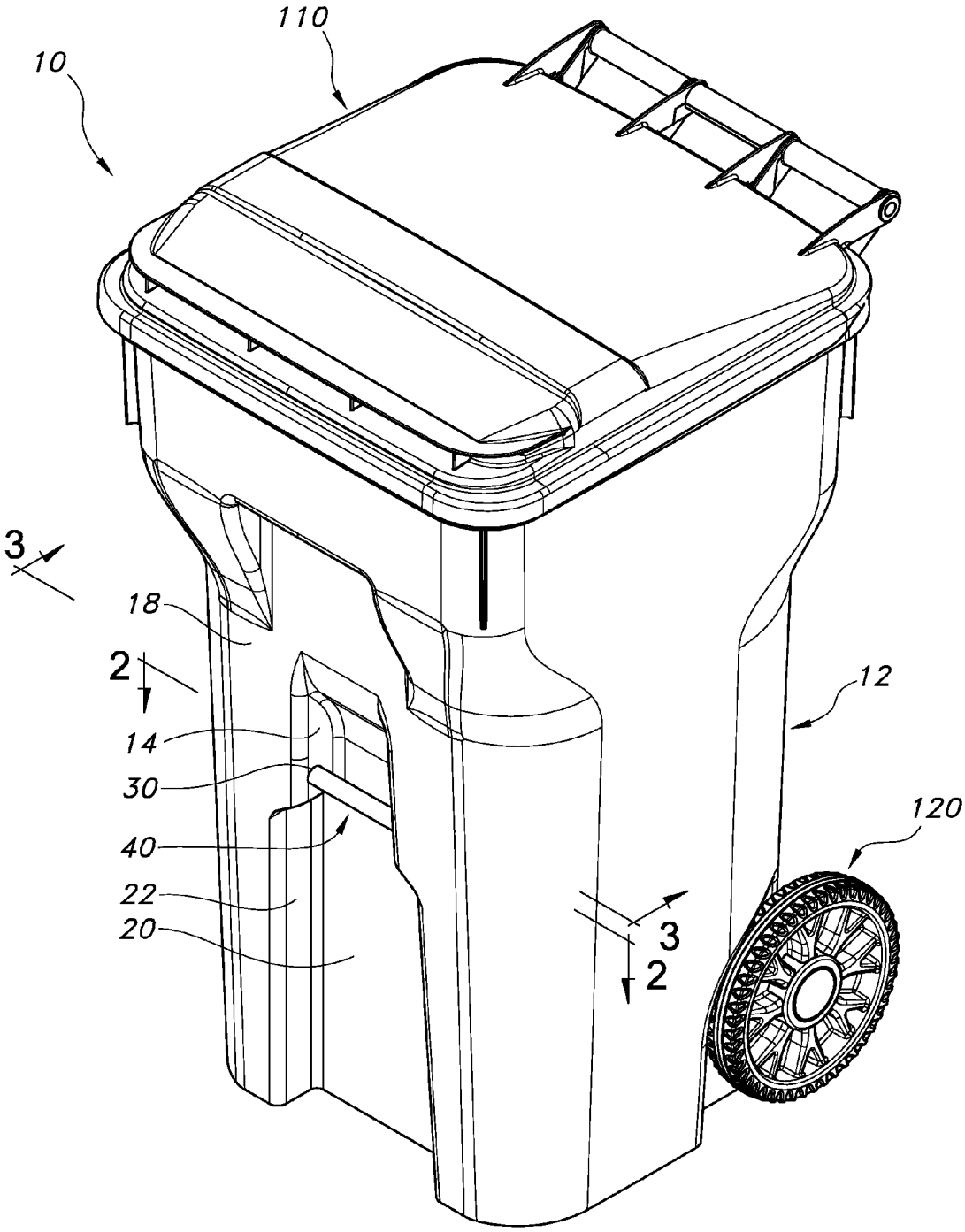
FIG. 1 is a perspective view of a waste cart in accordance with the present invention.

A wheeled waste container or cart is shown in FIG. 1 and is generally designated 10. The cart 10 generally includes a container 12, a grab bar 40, a lid 110 and at least one wheel 120.

The container 12 may have a first wall 14, a second wall 16, a third wall 18, a fourth wall 20, a fifth wall 22 and a sixth wall 24. The first wall 14 may define a first opening 30, and the second wall 16 may define a second opening 32. A space 33 may be defined between the first wall 14 and the second wall 16, which are separated by a distance d. The container 12 may include one or more positioning elements 60, 62 positioned outside of the space 33 between the first and second walls 14, 16, as described below.

The grab bar 40 has a first end 42 and a second end 44. The length of the grab bar 40 between the first end 42 and the second end 44 is greater than the distance d between the first opening 30 and the second opening 32, the distance between the first positioning element 60 and the second opening 32, and the distance between the second positioning element 62 and the first opening 30.

Figure 4:
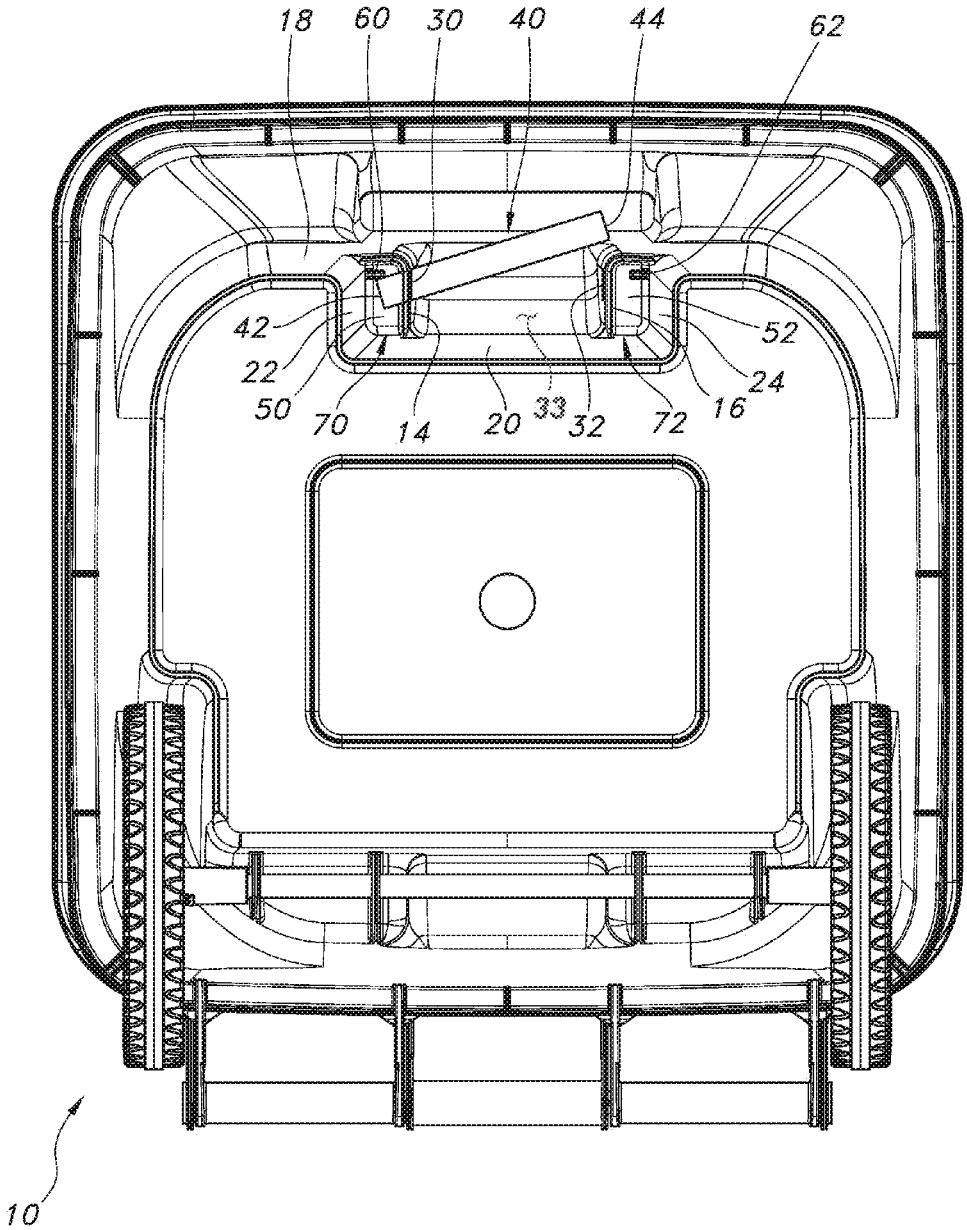
FIG. 4 is a bottom view of the cart.
Figure 5:
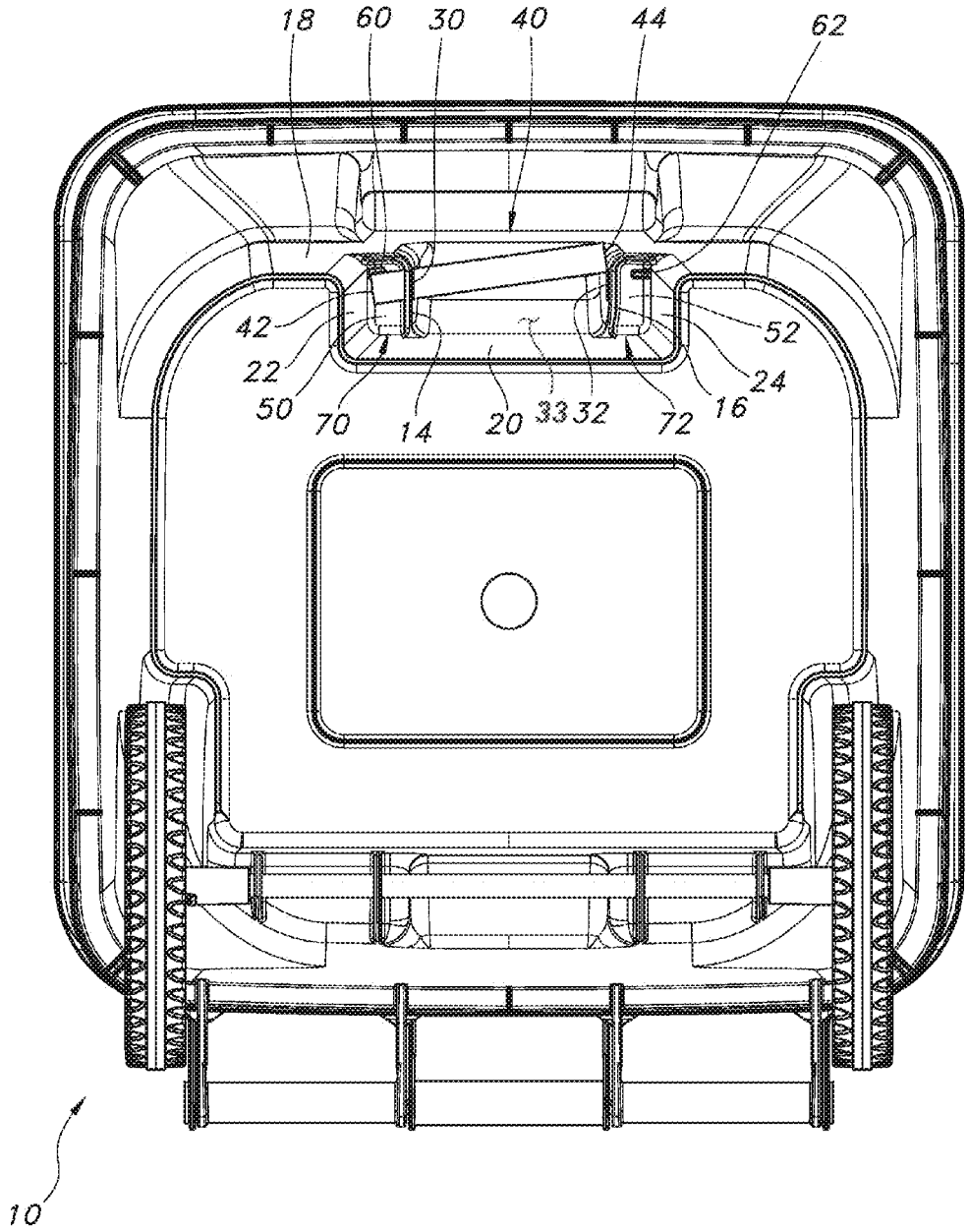
FIG. 5 is a bottom view of the cart.
Figure 6:
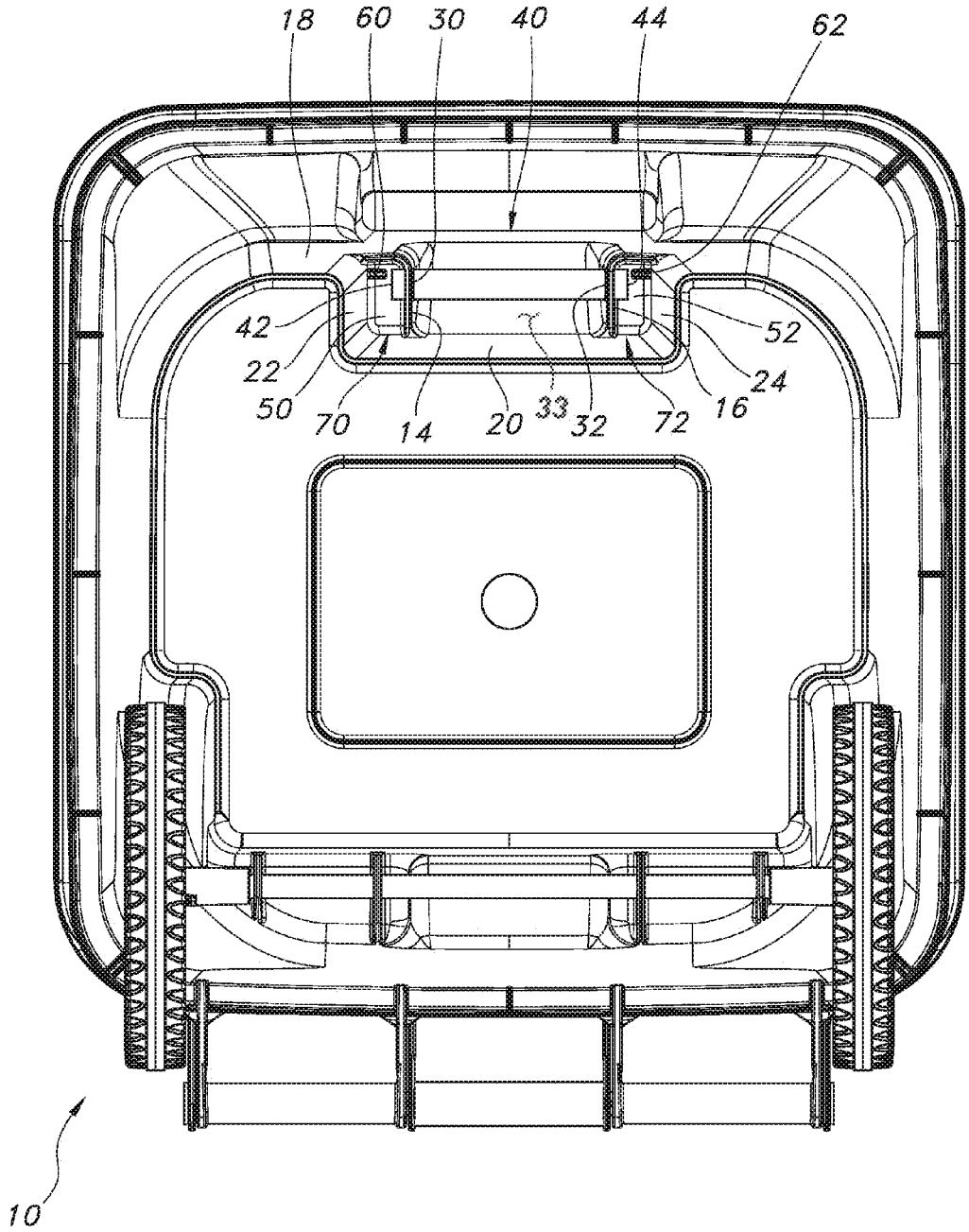
FIG. 6 is a bottom view of the cart.

The container 12 may include a first shelf 50, perhaps best shown in FIGS. 4-6. The first shelf 50 may extend partially or completely between the first wall 14, the third wall 18, the fourth wall 20 and the fifth wall 22. The container may include a second shelf 52, also perhaps best shown in FIGS. 4-6. The second shelf may extend partially or completely between the second wall 16, the third wall 18, the fourth wall 20 and the sixth wall 24. The shelves 50, 52 may also be contoured such that they smoothly transition into the other walls.

Figure 2:
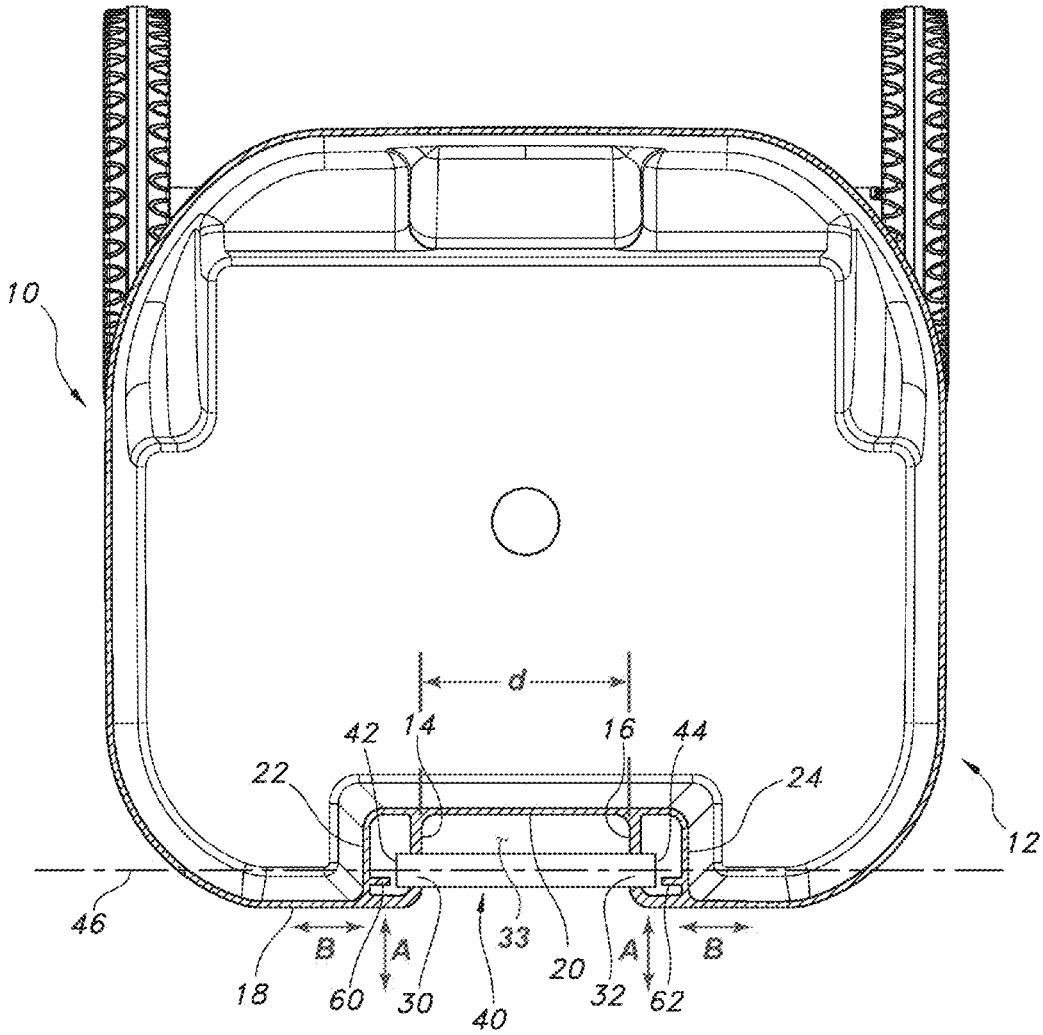
FIG. 2 is a sectional view taken along line 2-2 in FIG. 1.

The container 12 includes at least one positioning element, and may include a first positioning element 60 and a second positioning element 62 disposed at the respective ends 42, 44 of grab bar 40. The first positioning element 60 may be positioned at least partially between the fifth wall 22 and the first opening 30, and the second positioning element 62 may be positioned at least partially between the sixth wall 24 and the second opening 32. As shown in FIG. 2, the positioning elements 60, 62 constrain the lateral movement of the grab bar 40. In other words, the positioning elements 60, 62 allow the grab bar 40 to freely move laterally (in a direction between the positioning elements 60, 62), but prevent the grab bar 40 from moving a sufficient amount laterally to remove the grab bar 40 from one of the openings 30, 32. The positioning elements 60, 62 may also prevent the ends 42, 44 of the grab bar 40 from contacting the fifth wall 22 or the sixth wall 24, respectively, during use of the cart 10. If the container 12 only includes one positioning element, the fifth wall 22 or sixth wall 24 may be used to additionally constrain the lateral movement of the grab bar 40.

One or both of the positioning elements 60, 62 may be deformable to allow for installation of the grab bar 40, as described below. One or both of the positioning elements 60, 62 may also be easier deformed in one direction than in another. For example, less force may be required to deform the positioning element 60 in a forward/rearward direction A (toward the third wall 18 or fourth wall 20) than is required to deform the positioning element 60 in a lateral direction B (toward the fifth wall 22). One or both of the positioning elements 60, 62 may additionally or instead be easier deformed in [[a]] the direction B substantially parallel to the longitudinal axis 46 (see FIG. 2) of the grab bar 40 than in the direction A substantially perpendicular to the longitudinal axis 46 of the grab bar 40.

Figure 3:
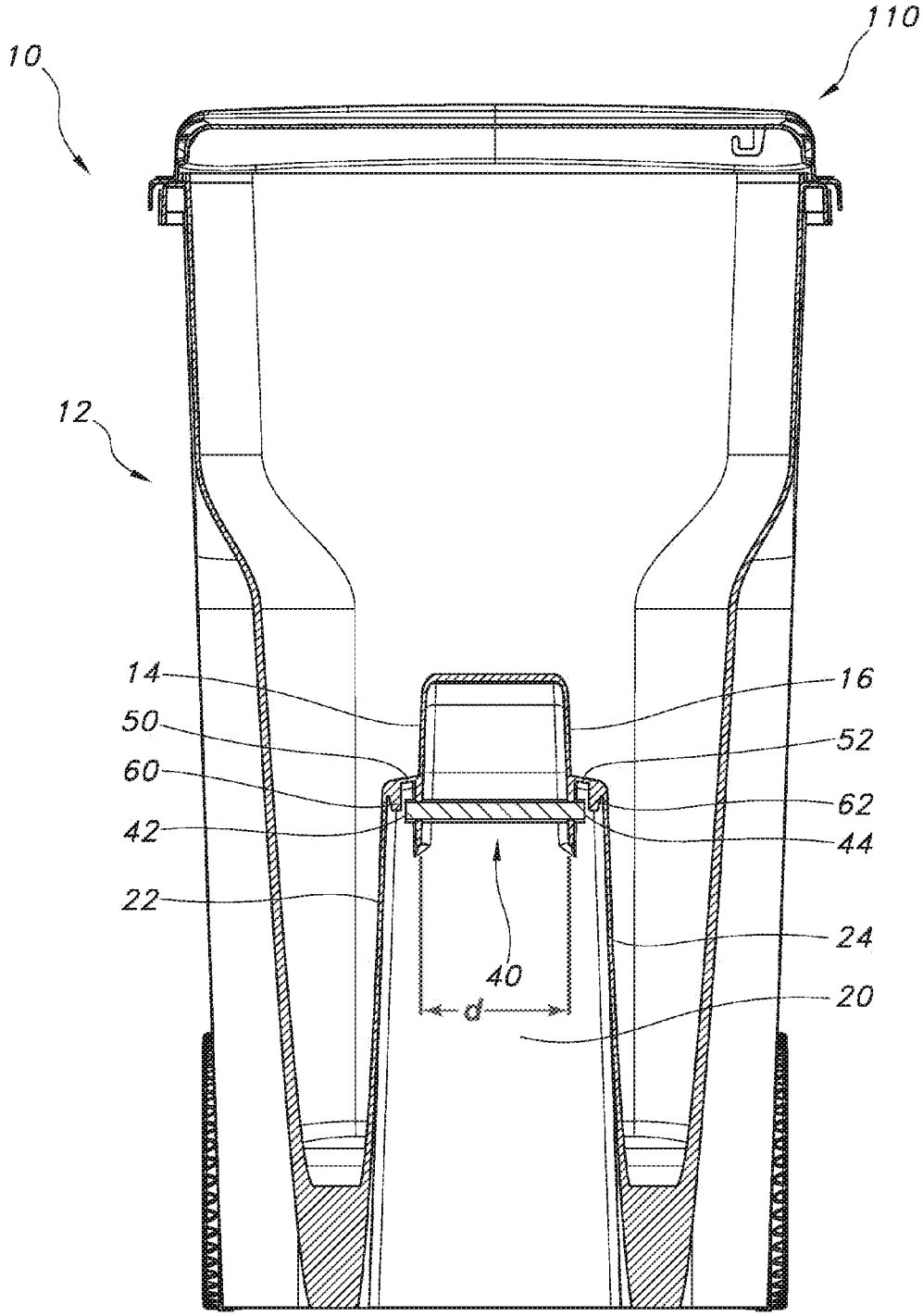
FIG. 3 is a sectional view taken along line 3-3 in FIG. 1.

As shown in FIG. 2, the positioning elements 60, 62 may extend from the fifth wall 22 and sixth wall 24 toward the grab bar 40 and toward the respective first and second openings 30, 32. The positioning elements 60, 62 may additionally or alternatively extend from the first shelf 50 and second shelf 52, as shown in FIG. 3. The positioning elements may additionally or alternatively extend from any other suitable structure, including the first wall 14, second wall 16, third wall 18 and fourth wall 20. The illustrated embodiment includes vertically extending ribs or tabs. However, the positioning elements 60, 62 may be of any shape suitable for the application, including extensions, ribs, and projections. The positioning elements 60, 62 may also be of any orientation suitable for the application. For example, the positioning elements 60, 62 may optionally include tabs oriented in a horizontal plane that extend from one or more of the walls and deform in a vertical direction (toward or away from the shelves 50, 52). As another example, the positioning elements 60, 62 may include a "Y" shaped member, with the base of the "Y" extending from the fifth wall 22 and sixth wall 24, respectively. The base of the "Y" may flex to allow installation of the grab bar 40. As a further example, the positioning elements may include a wall of material parallel to the ends 42, 44 of grab bar 40 and extending downward from shelves 50, 52. One or both of the walls may deform to allow insertion of the grab bar 40, then retain the grab bar 40 once it is installed. The positioning elements 60, 62 may each include more than one separate member to facilitate insertion and retention of the grab bar 40.

As shown in FIG. 2, the grab bar 40 has a longitudinal axis 46. The longitudinal axis 46 may be collinear with a longitudinal axis extending through the center points of openings 30, 32. In this configuration, the longitudinal axis 46 represents both the longitudinal axis of the grab bar 40 and the longitudinal axis of the openings 30, 32. The positioning elements 60, 62 may be offset from the longitudinal axis 46. In other words, as shown in FIG. 2, the positioning elements 60, 62 may be positioned more rearward (toward wall 20) or more forward (toward wall 18) than the longitudinal axis 46. As described below, the offset may allow for easier installation of the grab bar 40.

The container 12 may include a first access compartment 70 and a second access compartment 72. The first access compartment 70 may be defined by the first wall 14, the third wall 18, the fourth wall 20, the fifth wall 22 and the first shelf 50. The first access compartment 70 may instead be defined by any combination of these elements. The second access compartment 72 may be defined by the second wall 16, the third wall 18, the fourth wall 20, the sixth wall 24 and the second shelf 52. The second access compartment 70 may instead be defined by any combination of these elements. The first access compartment 70 and the second access compartment 72 may be generally open in a downward direction toward the bottom of the cart 10 to provide users access for repair and/or replacement of the grab bar 40.

The container 12 and grab bar 40 may each be made of a variety of materials, including plastic, composite, metal, steel, aluminum and any other suitable material. The container 12 and grab bar 40 may be manufactured with a variety of manufacturing processes, including injection molding, extrusion, thermoforming, machining and any other suitable process. The positioning elements 60, 62 and other elements of the container 12 described above may be integrally molded or may be manufactured separately and joined together.

The container 12 can be formed in any suitable size and shape. In the illustrated embodiment, the cart 10 is described in connection with a cart adapted to receive and store waste, yard waste, recyclable materials and/or other waste products. However, the container or cart of the present invention can be adapted for the receipt and storage of any other type of goods or products, including any goods that are typically stored in a container that is later emptied by being lifted and turned over. In the illustrated embodiment, the container 12 is generally square-shaped and has rounded edges. The container 12 forms a hollow chamber and includes an open upper end, through which the waste products can be placed into the container 12.

In the illustrated embodiment, the grab bar 40 is positioned on the front side of the cart 10. However, the container 12 may be configured to position the grab bar 40 on any other side of the cart 10 that would be accessible by either a worker or the waste truck. In the illustrated embodiment, the container is configured such that the grab bar 40 extends laterally at approximately the middle of the front side of the cart 10. However, the container 12 may be configured so the grab bar 40 extends in any direction and is positioned in any location on any side of the cart 10. In the illustrated embodiment, the first wall 14 and the second wall 16 are of a size sufficient to accommodate the respective openings 30, 32. The first wall 14 and second wall 16 are also wide enough to allow the openings 30, 32 to be spaced from the fourth wall 20, to provide clearance between the grab bar 40 and the fourth wall 20 when the grab bar 40 is joined with the container 12. This clearance allows either a worker or a machine on the waste truck to reach between the grab bar 40 and the fourth wall 20 to grab or grasp the grab bar 40 to lift the cart 10. The lateral configuration of the grab bar 40 may make it easier for the worker or machinery to grab the bar 40. However, as noted above, the grab bar 40 can be joined to the container 12 in a variety of other orientations.

Optionally, the waste cart 10 includes at least one wheel 120 for transporting the waste cart 10, such as from a house or garage to the curb, so that the waste contained in the cart 10 can be picked up. For example, a user can tilt the cart 10 onto the wheels 120 and push or pull the cart 10.

Optionally, the waste cart 10 includes a lid 110 that is adapted to cover the open end of the container 12. In the illustrated embodiment, the lid 110 is flexibly joined with the container 12 at a rear portion of the container 12. In the illustrated embodiment, the size and shape of the lid 110 corresponds to the size and shape of the open end of the container 12, such that the lid 110 fully covers the open end to close the container 12. The lid 110 may be formed from any suitable material, including plastic, composite, metal or any other suitable material.

To allow the machinery on the waste truck to more easily empty the contents of the cart 10, it may be beneficial to position the grab bar 40 on an opposite side of the container 12 from where the lid 110 is secured to the container 12. In this configuration, grab bar fingers on the waste truck machinery are able to catch behind the grab bar 40 with the cart up-ended. Both gravity and the force of the contents of the cart 10 press against the lid 110 to allow the lid 110 to easily open to allow the contents of the cart 10 to pour or fall out of the cart 10 into the waste truck.

II. Installation and Use

To install the grab bar 40 in a formed container 12, a user may insert the first end 42 of the grab bar 40 into the first opening 30. As shown in FIG. 4, the grab bar 40 may be inserted at an angle with respect to the fourth wall 20 so that the first positioning element 60 does not prohibit the grab bar 40 from being inserted. The grab bar 40 is inserted a sufficient distance into the first opening 30 so that the second end 44 of the grab bar 40 clears the second wall 16.

After insertion of the first end 42 into the first opening 30, the grab bar 40 is pivoted about the first opening 30 to align the second end 44 with the second opening 32, as shown in FIG. 5. During the pivoting movement of the grab bar 40, the first end 42 contacts and deforms the first positioning element 60. During the deformation, the grab bar 40 may act as a lever with an edge of the first opening 30 acting as a fulcrum to allow the user to deform the first positioning element 60.

As noted above, the positioning elements 60, 62 may be offset from the longitudinal axis 46 of the grab bar 40. In this offset configuration, less deformation is required of the first positioning element 60 during installation of the grab bar 40 than if the positioning element 60 were aligned with the longitudinal axis 46. As shown in FIG. 4, because the first positioning element 60 is positioned forward of the longitudinal axis of the grab bar 40 (in a direction toward the front of the cart 10), the grab bar 40 may be inserted at a relatively small angle with regard to the fourth wall 20 and the first positioning element 60 may be only slightly deformed (see FIG. 5) to align the second end 44 with the second opening 32. However, the positioning elements 60, 62 may be aligned with the longitudinal axis 46 if more security is desired. In other words, if the positioning elements 60, 62 are aligned with the longitudinal axis 46, undesired removal will be made more difficult because removal will involve greater deformation of at least one of the positioning elements 60, 62.

Once the second end 44 is aligned with the second opening 32, the grab bar 40 is moved laterally toward the second opening 32. After sufficient lateral travel, the first end 42 of the grab bar 40 comes out of contact with the first positioning element 60, which allows the first positioning element 60 to return to its original non-deformed orientation, as shown in FIG. 6. When the first positioning element 60 returns to its non-deformed orientation, the user may hear an audible "snap," which is a confirmation that the grab bar 40 is completely installed.

The grab bar 40 is removable from the container 12. However, the grab bar 40 must be removed manually or with a tool, such that the grab bar 40 will not likely be inadvertently removed from the container 12 during normal use. Specifically, a person would have to reach into the first or second access compartments 70, 72 and manually deform one of the positioning elements 60, 62 to allow the grab bar 40 to be moved a sufficient distance laterally to remove the grab bar 40 from one of the openings 30, 32. Alternatively, a person could deform one of the positioning elements 60, 62 with a suitable tool adapted for this purpose.

Because the grab bar 40 is formed separately from the container 12 and can be removed from the container 12, various grab bars can be used interchangeably on various containers. Thus, if the container 12 or lid 110 of the cart 10 were to break or become cracked, the grab bar 40 could be removed from the container 12 and used with another container to form another cart. Similarly, if the grab bar 40 were to become damaged, the damaged grab bar 40 could be removed and replaced with a replacement grab bar.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," or "the" is not to be construed as limiting the element to the singular.

The embodiments of the invention in which an exclusive property or privilege is claimed are defined as follows:

1. A waste container comprising:

a one-piece container including first and second wall portions defining first and second openings respectively, the first and second wall portions separated by a first distance and defining a space therebetween, the one-piece container further including first and second positioning elements outside of the space and aligned with the first and second openings respectively;

a grab bar within the space and extending through the first and second openings, the grab bar having a length greater than (a) the first distance, (b) the distance between the first positioning element and the second opening, and (c) the distance between the second positioning element and the first opening, whereby the grab bar is retained within the first and second openings between the first and second positioning elements.

2. The waste container of claim 1 wherein at least one of the first and second positioning elements is resiliently movable.

3. The waste container of claim 2 wherein:

the grab bar has a longitudinal axis; and the first and second positioning elements are offset from the longitudinal axis.

4. The waste container of claim 3 wherein the grab bar is able to move between the positioning elements.

5. The waste container of claim 4 wherein the container includes a first shelf and a second shelf, the first positioning element extending downward from the first shelf, the second positioning element extending downward from the second shelf.

6. The waste container of claim 5 wherein:

the container includes third and fourth wall portions;

the first, third and fourth wall portions and the first shelf define a first access compartment; and the second, third and fourth wall portions and the second shelf define a second access compartment.

7. A method of making a waste container comprising:

forming a one-piece container having a first wall portion defining a first opening, a second wall portion defining a second opening, a first positioning element aligned with the first opening, and a second positioning element aligned with the second opening, the first and second wall portions defining a space therebetween, the first and second positioning elements being outside of the space;

providing a grab bar having first and second ends, the grab bar having a length greater than (a) the distance between the first and second openings, (b) the distance between the first positioning element and the second opening, and (c) the distance between the second positioning element and the first opening;

inserting the first end of the grab bar through the first opening from the space and beyond the first positioning element;

aligning the second end of the grab bar with the second opening;

inserting the second end of the grab bar through the second opening until the grab bar is positioned between the first and second positioning elements, whereby the grab bar is retained within the first and second openings between the first and second positioning elements.

8. The method of claim 7 wherein the aligning step includes moving the first positioning element with the grab bar.

* * * * *